US008321965B2

(12) United States Patent
Newman

(10) Patent No.: US 8,321,965 B2
(45) Date of Patent: Dec. 4, 2012

(54) COMBINED HEAD AND NECK PROTECTOR

(76) Inventor: James Newman, Edmonton (CA)

( * ) Notice: Subject to any disclaimer, the term of this patent is extended or adjusted under 35 U.S.C. 154(b) by 448 days.

(21) Appl. No.: 12/222,744

(22) Filed: Aug. 15, 2008

(65) Prior Publication Data

US 2009/0044314 A1 Feb. 19, 2009

Related U.S. Application Data

(60) Provisional application No. 60/935,504, filed on Aug. 16, 2007.

(51) Int. Cl.

| | |
|---|---|
| ***A42B 7/00*** | (2006.01) |
| ***A42B 1/06*** | (2006.01) |
| ***A42B 1/24*** | (2006.01) |
| ***A63B 71/10*** | (2006.01) |
| ***A41D 27/26*** | (2006.01) |

(52) U.S. Cl. ..... 2/421; 2/410; 2/422; 2/425; 2/468

(58) Field of Classification Search ..... 2/459, 460, 2/461, 410, 6.1, 6.2, 411, 412, 413, 414, 2/415, 421, 422, 425, 468, 467; D29/101.2, D29/102, 103

See application file for complete search history.

(56) References Cited

U.S. PATENT DOCUMENTS

| | | | | |
|---|---|---|---|---|
| 2,923,942 | A * | 2/1960 | Lee | 2/418 |
| 3,001,199 | A * | 9/1961 | Williams et al. | 2/6.1 |
| 3,502,074 | A * | 3/1970 | Jones et al. | 128/202.11 |
| 4,290,150 | A * | 9/1981 | Guerre-Berthelot | 2/421 |
| 4,425,667 | A * | 1/1984 | Harrison | 2/462 |
| 4,467,475 | A * | 8/1984 | Gregory et al. | 2/462 |
| 4,516,273 | A * | 5/1985 | Gregory et al. | 2/462 |
| 4,825,476 | A * | 5/1989 | Andrews | 2/461 |
| 4,996,720 | A * | 3/1991 | Fair | 2/462 |
| 5,295,271 | A * | 3/1994 | Butterfield et al. | 2/410 |
| 5,353,437 | A * | 10/1994 | Field et al. | 2/462 |
| 5,444,870 | A * | 8/1995 | Pinsen | 2/461 |
| 5,546,601 | A * | 8/1996 | Abeyta | 2/468 |
| 5,930,843 | A * | 8/1999 | Kelly | 2/468 |
| 6,006,368 | A * | 12/1999 | Phillips | 2/468 |
| 6,009,566 | A * | 1/2000 | Hubbard | 2/468 |
| 6,052,835 | A * | 4/2000 | O'Shea | 2/468 |
| RE36,691 | E * | 5/2000 | Pinsen | 2/468 |
| 6,308,345 | B1 * | 10/2001 | Williams, Jr. | 2/468 |
| 6,892,393 | B1 * | 5/2005 | Provost et al. | 2/10 |
| 6,961,963 | B2 * | 11/2005 | Rosie | 2/171.3 |
| 7,155,747 | B2 * | 1/2007 | Baker | 2/422 |
| 7,371,221 | B1 * | 5/2008 | Baker | 602/18 |
| 7,849,525 | B2 * | 12/2010 | Ghajar | 2/416 |
| 2004/0128744 | A1 * | 7/2004 | Cleveland | 2/422 |

FOREIGN PATENT DOCUMENTS

WO WO 9103178 A1 * 3/1991

* cited by examiner

*Primary Examiner* — Shelley Self
*Assistant Examiner* — Yane Yoon
(74) *Attorney, Agent, or Firm* — George A. Seaby

(57) ABSTRACT

A head and neck protector for use by a race car or other driver includes a yoke which is mounted on the shoulders of the driver, and a helmet which is mounted on a portion of the yoke extending around the sides and back of the driver's neck. The helmet is securely latched to the yoke to prevent rotation of the helmet relative to the yoke. The interior volume of the helmet is sufficiently large that the driver can freely move his or her head without corresponding movement of the helmet.

5 Claims, 5 Drawing Sheets

COMBINED HEAD AND NECK PROTECTOR

This application claims priority on U.S. Provisional Application No. 60/935,504 filed Aug. 16, 2007.

BACKGROUND OF THE INVENTION

1. Field of the Invention

This invention relates to a head and neck protector for use by a vehicle driver and in particular a race car driver.

2. Description of Related Art

The most common head and neck protection for a race car driver is provided by a helmet and a so-called HANS® device. The helmet, usually similar to a motorcycle helmet, fits snugly on the head of the driver and is retained on the wearer's head by a chin strap. A HANS device is a yoke or collar having two sides for resting on the shoulders of a driver, and a rear portion extending behind the neck and head of the driver. The two arcuate sides of the device rest on the shoulders of the driver and extend downwardly to the driver's chest. The device is held in position by a conventional race vehicle shoulder harness. The rear portion of the device is connected to the helmet by tethers which, in a crash, safely limit movement of the head and neck of the driver.

Under normal driving circumstances, a race car driver makes two lateral head motions, namely turning and tilting. Turning the head left and right, used in conjunction with peripheral vision and a side mounted rearview mirror is required to see another race car approaching from behind. Tilting the head happens when cornering, i.e. tilting the head in the direction of the corner.

The usual crashes involving race vehicles are front, rear and lateral or oblique crashes. When using existing head and neck protection, especially during a front or lateral crash, head and neck motion is defined by the rapid deceleration due to tightening of the tethers between the helmet and the yoke.

BRIEF SUMMARY OF THE INVENTION

An object of the present invention is to provide a head and neck protector for a vehicle driver which permits a range of driver head motion comparable to that provided by a helmet and HANS device while providing a higher level of protection.

Accordingly, the invention relates to a head and neck protector for use by a vehicle driver comprising:

(a) a yoke for mounting on the shoulders of the driver including:
  (i) a pair of arcuate sides for extending over the shoulders on either side of the neck and
  (ii) a collar extending upwardly from and between the sides of the yoke;
(b) a helmet removably mounted on the yoke having an interior volume larger than the driver's head permitting free movement of the head in the helmet without corresponding movement of the helmet; and
(c) a latch for securely latching the helmet to the yoke collar, whereby movement of the helmet relative to the yoke is prevented.

BRIEF DESCRIPTION OF THE DRAWINGS

A suitable protector for achieving the above-identified object is described below with reference to the accompanying drawings, which illustrate a preferred embodiment of the protector, and wherein.

DETAILED DESCRIPTION OF THE INVENTION

Figure 1:
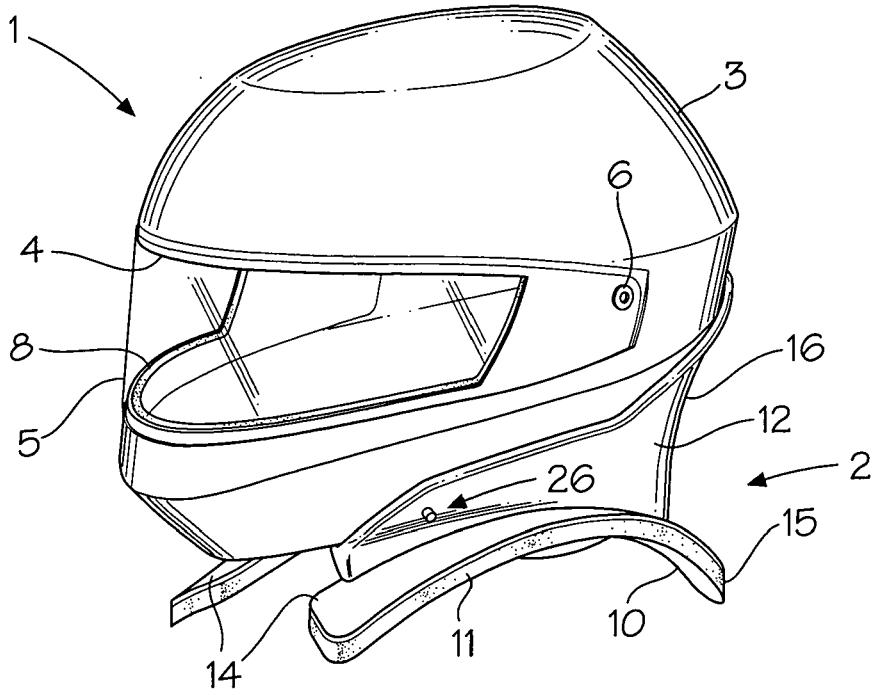
FIG. 1 is an isometric view from in front and one side of a head and neck protector in accordance with the invention.
Figure 2:
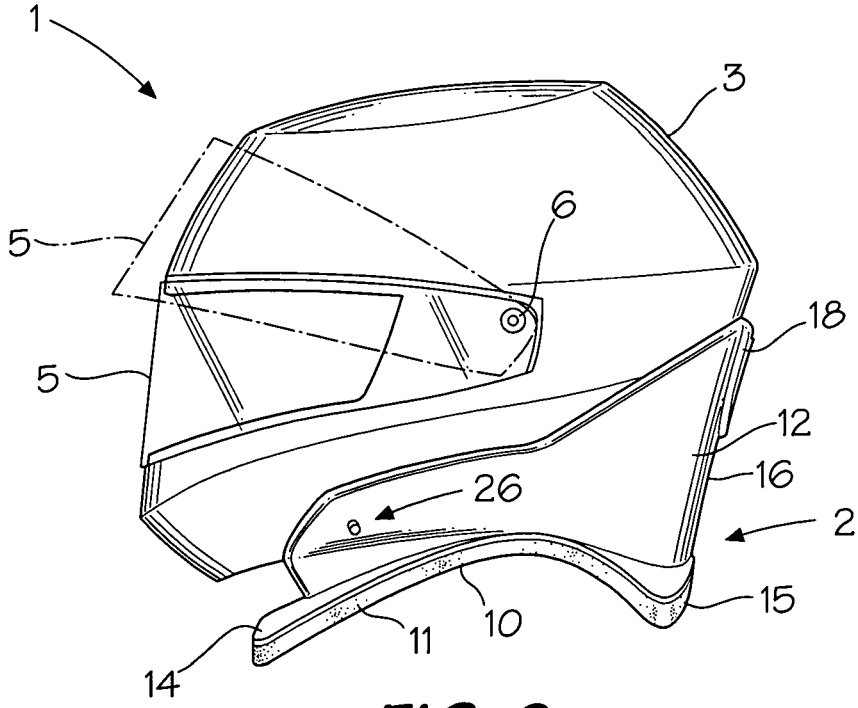
FIG. 2 is a side view of the protector of FIG. 1 in the assembled or use condition.
Figure 3:
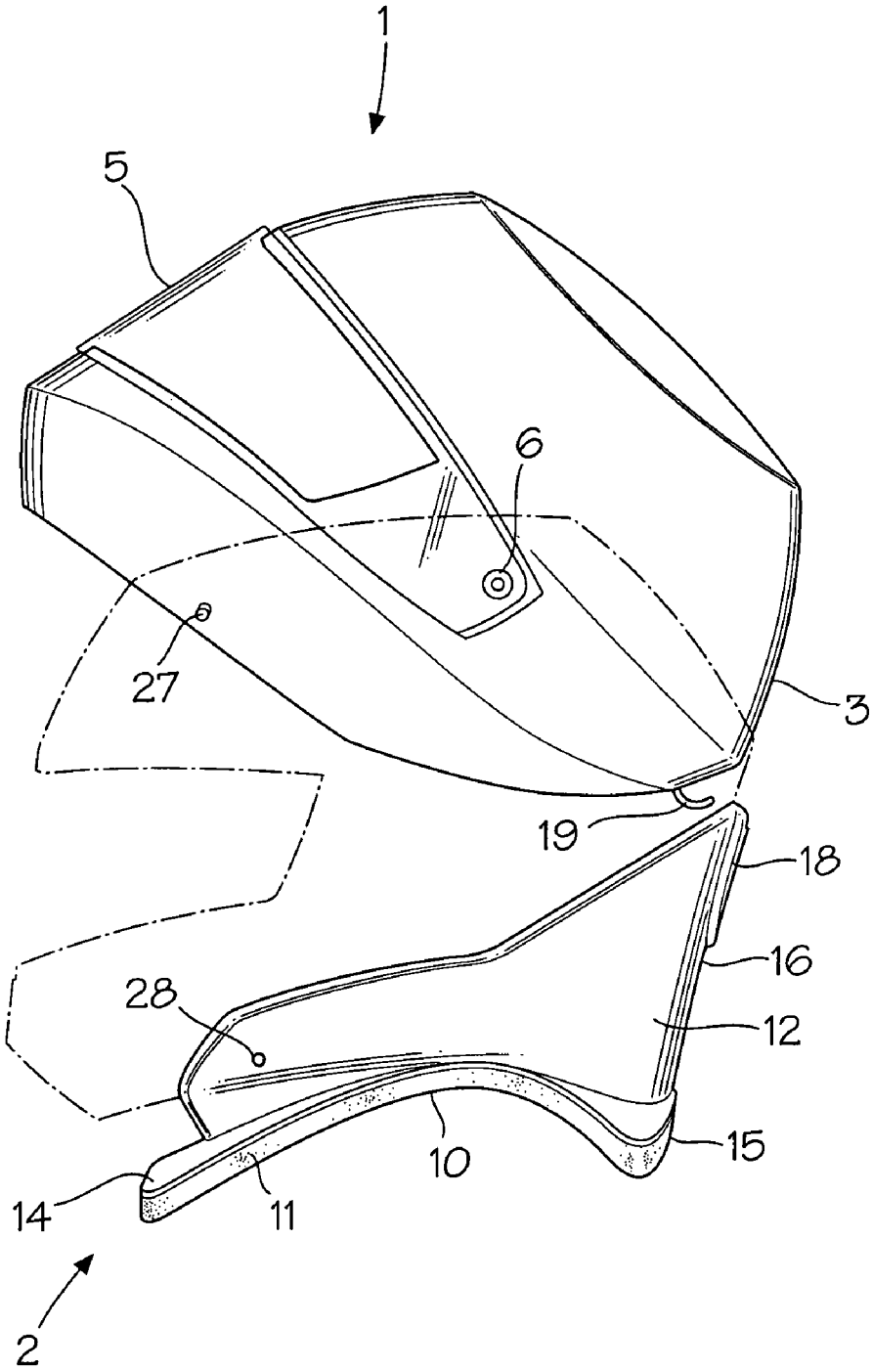
FIG. 3 is an exploded side view of the assembly of FIGS. 1 and 2.
Figure 4:
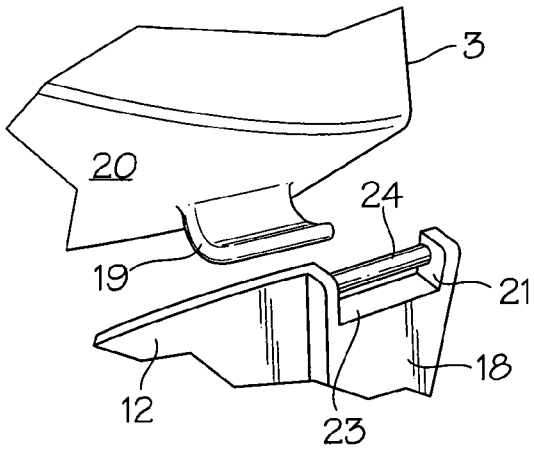
FIG. 4 is an isometric, exploded view of a latch device used on the rear of the assembly of FIGS. 1 to 3 in the released positions.
Figure 5:
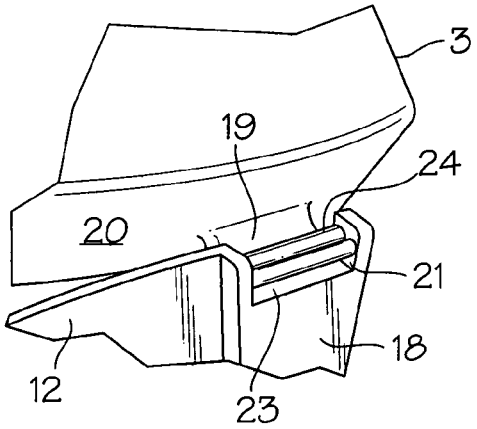
FIG. 5 is an isometric view of the latch device of FIG. 4 in the engaged or latched position.
Figure 6:
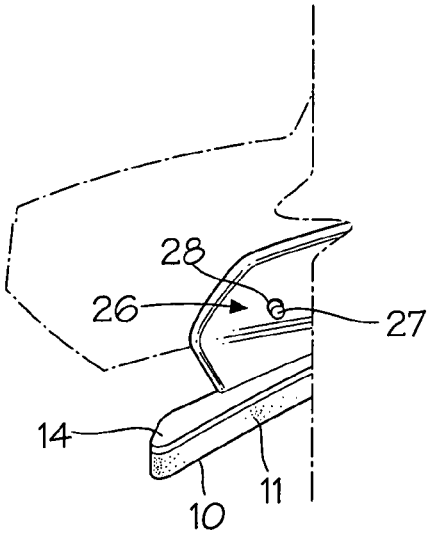
FIG. 6 is an isometric view of the front end of a yoke and a front latch of the protector of FIGS. 1 to 3.

Referring to FIGS. 1 and 2, a head and neck protector in accordance with the invention includes a helmet and a yoke indicated generally at 1 and 2, respectively. An important feature of the helmet 1 is that it is larger than the head of a driver which permits lateral or side to side turning of the driver's head without turning the helmet. As mentioned above, existing helmets fit snugly against a driver's head. Consequently turning of the head is accompanied by turning of the helmet which is limited by the tethers attaching the helmet to the yoke.

The helmet 1 includes a streamlined shell 3 with a large eye port 4 covered by a visor 5, which can be rotated around pins 6 (one shown) from the closed position shown in solid lines in FIGS. 1 and 2 to an open position shown in phantom outline in FIG. 2. A liner 8 formed of foam or another suitable material is provided in the shell 3. There is sufficient clearance between the inner surface of the liner 8 and the head of a driver to permit unobstructed turning of the driver's head. It is also possible to tilt the head to one side or the other within the helmet. As mentioned above, drivers often tilt their heads when cornering to the extent possible within the structure of their vehicles. In some cases, when this occurs, rattling of the helmet while it rests against a roll bar (for example) is extremely distracting. The ability to be able to tilt the head freely in the helmet is a desirable feature of the helmet of the present invention, particularly because the weight of the helmet is not being borne by the head and neck. Neck muscle fatigue is a significant problem in auto racing. Removing the helmet weight from the wearer's head substantially reduces loads on neck muscles and hence reduces tiredness and soreness.

The yoke 2 includes a pair of arcuate sides 10 for resting on the shoulders of a driver. Pads 11 are provided on the bottom of each side 10. In use, the straps (not shown) of a conventional race car harness extend over the sides 10 to hold the yoke 2 tight against the shoulders, effectively connecting the driver to the vehicle. A collar 12, which is generally U-shaped when viewed from above or below, interconnects the inner edges of the sides 10, extending upwardly from proximate the front ends 14 to the rear end 15 of the sides. The rear end 16 of the collar 12 is substantially higher than the front end thereof. The collar 12 extends around a driver's neck to protect the latter. The flaring top of the collar 12 defines a support for the bottom end of the helmet 1.

The rear end of the helmet 1 is connected to a thick flat section 18 of the top, rear end of the yoke 2 by a generally C-shaped hook 19 extending outwardly and downwardly from the inclined bottom end 20 of the helmet 1, and a slot 21 in the top end of the section 18 of the collar 12. The slot 21 is formed by a rectangular notch 23 in the top of the section 18 and a bar 24 extending between the sides of the notch.

The front end of the helmet 1 is connected to the front end of the yoke 2 by latches (one shown) indicated generally at 26 on each side of the assembly. Each latch 26 is defined by a retractable spring loaded pin 27 extending outwardly from the bottom side of the helmet 1 through a hole 28 in the front end of the collar 12. It will be appreciated that other forms of latches can be used to secure the front end of the helmet 1 to the yoke 2.

If the driver's head is permitted to move violently forward, with respect to the body, injuries can and often do occur. With the protector of the present invention, the head and neck of the driver cannot move a substantial distance relative to the body, and the risk of injury is reduced. During a collision, the driver's head will contact the front, rear and/or sides of the foam liner 8.

Figure 7:
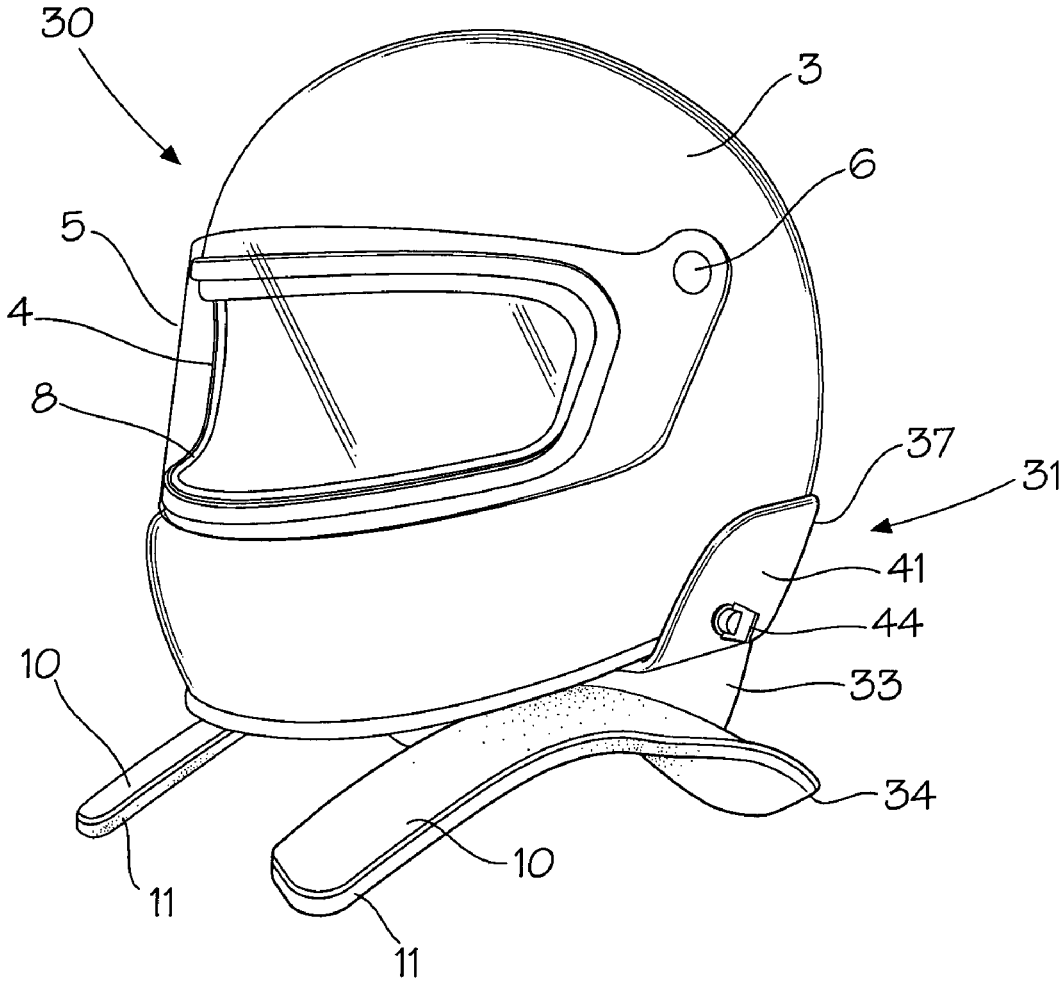
FIG. 7 is an isometric view of a second embodiment of the head and neck protector as viewed from the front and one side.
Figure 8:
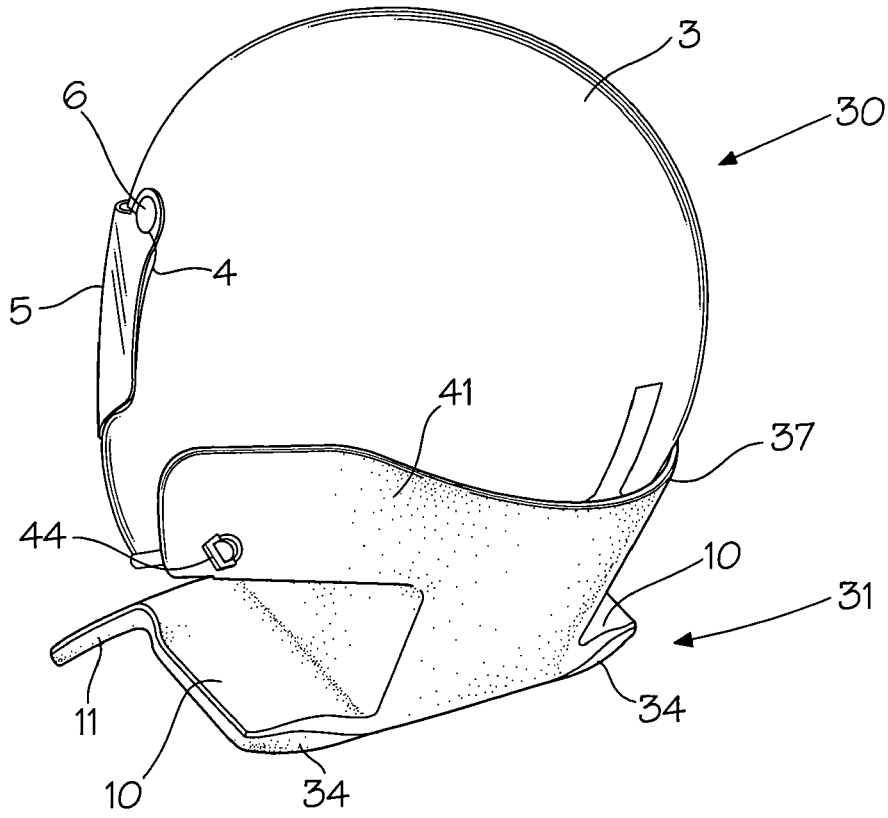
FIG. 8 is an isometric view of the head and neck protector of FIG. 7 as viewed from the rear and one side.
Figure 9:
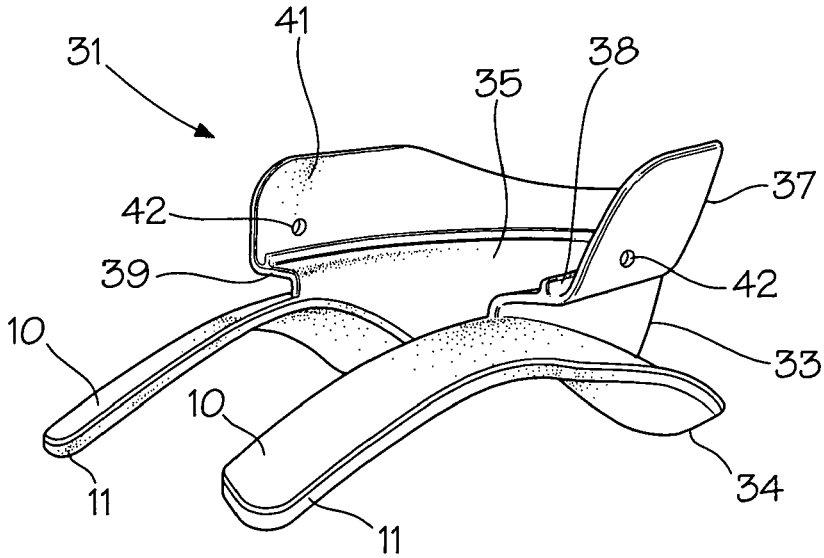
FIG. 9 is an isometric view of a yoke used in the protector of FIGS. 7 and 8.

The protector of FIGS. 7 to 9 is essentially the same as that of FIGS. 1 to 6, and accordingly wherever possible the same reference numerals are used to identify the same or similar elements.

Referring to FIGS. 7 to 9, the second embodiment of the head and neck protector includes a helmet and a yoke indicated generally at 30 and 31, respectively. The helmet 30 is similar in shape to a conventional off-the-shelf racing car driver's helmet, except that it is larger than the head of a driver, i.e. when in use, there is space between the driver's head and the liner. Thus, the helmet 30 includes a shell 3 with an eye port 4 covered by a visor 5 which can be rotated around pins 6 (one shown) between open and closed positions. A liner 8 formed of foam or another suitable resilient material is provided in the shell 3.

The yoke 31 includes a pair of arcuate, generally horizontal sides 10 for resting on the shoulders of a driver. Pads 11 are provided on the bottom of each of the sides 10. A generally U-shaped, neck protecting collar 33 extends upwardly from and interconnects the rear ends 34 of the sides 10. The inner surface 35 of the collar 33 can be padded for comfort. There also can be a slight clearance between the collar 33 and the neck of a wearer to permit free movement of the neck and head in the protector.

The top end of the collar 33 is defined by a helmet support 37 of generally L-shaped cross section. The helmet support 37 extends outwardly and upwardly from the upper end of the collar 33. A recess 38 in a horizontal ledge portion 39 of the support 37 receives the bottom rear end of the helmet 30. For such purpose, the helmet support 37 includes an arcuate skirt 41 having the same shape as the rear bottom end of the helmet 30. Holes 42 (FIG. 9) near the front ends of the skirt 41 receive off-the-shelf quarter turn clamps 44 (one shown) for releasably locking the helmet 30 to the yoke 31. The stems or shafts of the clamps 44 extending through the holes (not shown) in the helmet 30 align with the holes 42 in the skirt 41 when the helmet is placed on the yoke 31. Of course, additional latch means can be provided at the rear of the helmet as is the case with the helmet and yoke of FIGS. 1 to 6. Moreover, the quarter turn clamps 44 can replace the spring pins 27 in the protector of FIGS. 1 to 6.

Important attributes of the protector described above are that:

(a) it is relatively safe in a collision because:
- head and neck motion is more programmable than with existing systems, i.e., the impact response of the head/neck can be tailored to specific crash environments and not be dependent solely on the energy absorption characteristics of a motorcycle helmet and two attached straps or tethers,
- it provides improved protection against rotational acceleration loading,
- it eliminates compressive loading of cervical vertebrae because no component of an impact is transferred to the neck,
- it allows for the provision of greater penetration resistance,
- it provides easy emergency access to a driver's airway,
- it can be removed in an emergency without imposing tensile or bending loads on the neck, and (b) it is good for driver operations because:
- the weight of the helmet is moved to the shoulders, reducing G force induced neck fatigue,
- volitional head motion is quicker and easier when the helmet mass is not supported by the head and neck,
- ventilation is better, since there is no direct contact between the head and helmet,
- the peripheral field of view can be improved by using a larger visor, and
- there are no aerodynamic (lifting, buffeting) effects on the head with better streamlining Other advantages of the protector include the fact that it makes it easier to wear eyeglasses, a balaclava and communication gear, a single model can fit a range of head sizes and seating positions, and the helmet is easy to put on and remove by the driver or crew.

The invention claimed is:

1. A head and neck protector for use by a race car driver comprising:

(a) a yoke for mounting on the shoulders of the driver including:
  (i) a pair of arcuate sides for extending over the shoulders on either side of the neck, said yoke having a length sufficient to extend completely over the shoulders from front to rear thereof and a width sufficient to support a race car harness, and
  (ii) a collar extending upwardly from a rear end and the sides of the yoke;

(b) a helmet removably mounted on the yoke having an interior volume larger than the driver's head permitting free movement of the head in the helmet without corresponding movement of the helmet;

(c) latches for securely latching the helmet to the yoke collar, whereby movement of the helmet relative to the yoke is completely prevented; and (d) a helmet support on a top end of said collar for receiving a bottom end of a rear portion of the helmet, said helmet support including:
  (i) a horizontal ledge extending outwardly from a top end of said collar extending around a rear end of the collar and partly along the sides thereof;
  (ii) an arcuate recess in said ledge extending around the rear end and along the outer edges of the sides of said ledge for receiving the bottom of the rear end and portions of the sides of the helmet; and
  (iii) an arcuate skirt flaring upwardly and outwardly from the ledge for extending around and supporting the bottom of portions of the sides and the rear end of the helmet.

2. The head and neck protector of claim 1, wherein said latches include a hook on a rear end of the helmet and a slot in the top rear end of said collar.

3. The head and neck protector of claim 2, wherein said latches include holes in said collar, and spring loaded pins on the helmet for extending through said holes when the helmet in mounted on the yoke.

4. The head and neck protector of claim 1, wherein said latches include quarter turn clamps for extending through said skirt into the helmet.

5. The head and neck protector of claim 1, wherein the rear end of said collar is higher than the sides thereof.

* * * * *